United States Patent [19]

Hant

[11] 4,091,306

[45] May 23, 1978

[54] AREA ELECTRON GUN EMPLOYING FOCUSED CIRCULAR BEAMS

[75] Inventor: William Hant, Los Angeles, Calif.

[73] Assignee: Northrop Corporation, Los Angeles, Calif.

[21] Appl. No.: 766,362

[22] Filed: Feb. 7, 1977

[51] Int. Cl.[2] ..... H01J 29/50

[52] U.S. Cl. ..... 313/409; 313/302; 313/304; 313/420; 331/94.5 PE

[58] Field of Search ..... 331/94.5 PE; 313/398, 313/409, 302, 304, 414, 415, 416, 420

[56] References Cited

U.S. PATENT DOCUMENTS

| | | | |
|---|---|---|---|
| 3,702,973 | 1/1972 | Daugherty et al. | 331/94.5 PE |
| 3,876,958 | 4/1975 | Parker | 331/94.5 PE |
| 3,906,392 | 9/1975 | Mann | 331/94.5 PE |
| 3,935,500 | 1/1976 | Oess et al. | 313/409 |
| 3,940,710 | 2/1976 | Lemay | 331/94.5 PE |
| 3,956,712 | 5/1976 | Hant | 313/343 |

*Primary Examiner*—Saxfield Chatmon, Jr.
*Attorney, Agent, or Firm*—Edward A. Sokolski

[57] ABSTRACT

Thermionic filaments are arranged in an array which covers a predetermined area. A spreader electrode which may be in the form of a flat plate is placed on one side of the filaments with an anode being placed on the other side of the filaments, and an accelerator grid, focusing plate and collimation plate being placed in that order between the filaments and the anode. The anode is in the form of a foil through which the electrons pass into an area where they are utilized, such as for example a laser cavity where they are utilized to ionize the laser gas. The foil anode is supported on an apertured structure which facilitates the formation of a vacuum tight seal of the vacuum envelope containing the gun and functions as a heat sink to dissipate some of the heat energy developed in the foil. The anode support structure, focusing plate and collimating plate all have apertures formed therethrough which form a plurality of cylindrical channels, these channels covering substantially the entire surface area of the foil anode. The apertures of the support structure, focusing plate and collimation plate are aligned with each other to provide channeled pathways for the electrons between the filaments and the anode. Potentials are applied to the focusing and collimation plates to focus the electrons into circular beams which efficiently pass through the channels between the filaments and the anode with a minimum dissipation of energy in the structures forming the channels.

7 Claims, 2 Drawing Figures

AREA ELECTRON GUN EMPLOYING FOCUSED CIRCULAR BEAMS

This invention relates to electron guns, and more particularly to such a gun utilizing thermionic filaments which provides a uniform distribution of electrons over a predetermined area.

Area electron guns such as described in my U.S. Pat. No. 3,956,712 issued May 11, 1976, are useful for various applications including the pre-ionization of laser gas for stabilizing the operation of electric discharge lasers. My aforementioned patent describes a device which is capable of providing a highly uniform electron flow over a relatively large area, with relatively high efficiency. In the device of this patent, such improvement in efficiency is achieved by positioning the filaments so they are centered between the grid wires and focusing the electrons so that they strike the foil at points therealong between the anode support structure, thus avoiding dissipation of energy in such structure. It is to be noted that the average current capability of electron guns utilized in the stabilization of electric discharge lasers is ultimately limited by the beam energy that can be tolerably dissipated in the anode foil, this current density limit being determined by the maximum temperature rise that can be tolerated in the foil and its support structure. The focusing technique utilized in my aforementioned prior patent greatly reduces the dissipation of energy in the support structure elements. However, it requires that the filaments be accurately positioned so they are centered between the grid wires. The present invention is an improvement over that of my prior patent in providing a substantially further reduction in energy dissipation with the resultant improvement in efficiency and increased gun current capability. This end result is achieved by channeling the electrons into a plurality of focused beams which cover the area of the anode, these beams passing through circular apertures formed in the anode support structure and thence through the anode foil. This makes for circular foil areas through which the beams pass which afford better thermal conduction from their centers than the rectangular area slits of my prior patent. Further, the accurate alignment of the filaments needed in the device of my prior patent is obviated with the use of the circular channels of the present device.

It is therefore an object of this invention to improve the efficiency of operation of area electron guns.

It is a further object of this invention to increase the average current capability of area electron guns.

It is still another object of this invention to provide means for reducing the dissipation of energy and the generation of heat in area electron guns.

Figure 1:
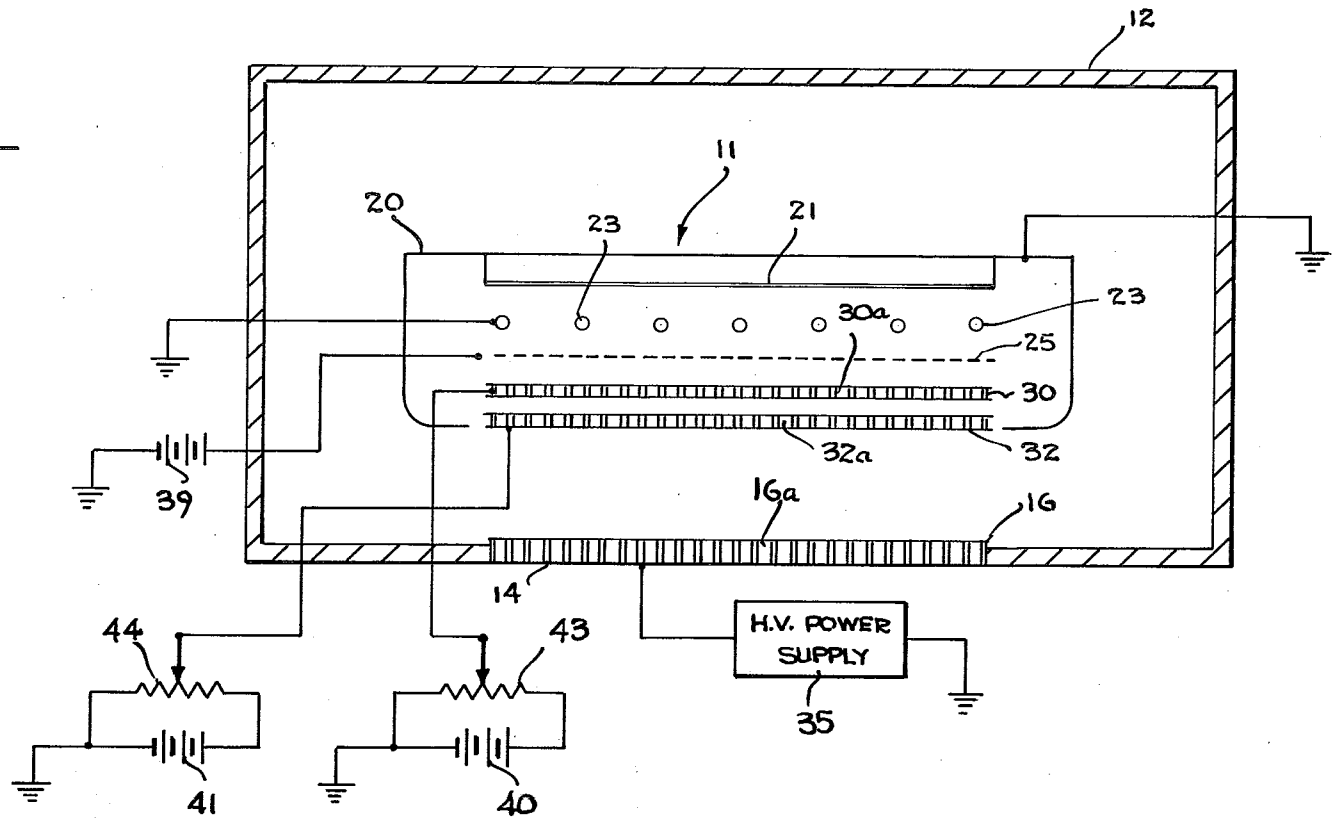
Figure 2:
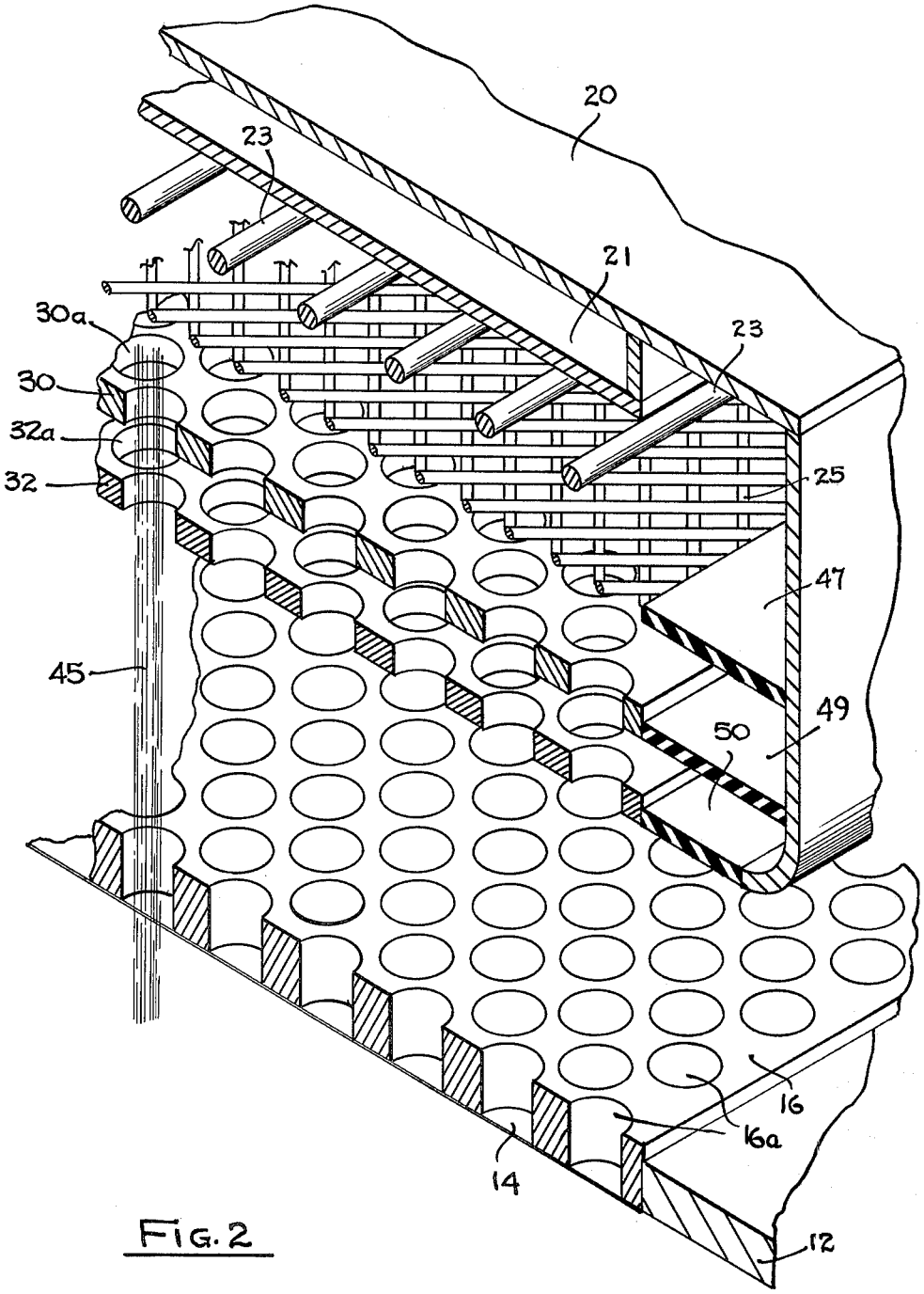

Other objects of this invention will become apparent as the description proceeds in connection with the accompanying drawings, of which:

FIG. 1 is a schematic drawing illustrating a preferred embodiment of the invention; and FIG. 2 is a perspective view illustrating an implementation of the preferred embodiment.

Briefly described, the device of my invention is as follows: A plurality of thermionic filaments are arranged in an array to cover a predetermined area needed to provide electrons to cover the area of an anode which is in the form of a thin flat foil and support structure. The anode support structure has a plurality of circular apertures formed therethrough and having the general appearance of a honeycomb. Also, placed between the filaments and the anode are an accelerator grid, which may be in the general form of a screen, a focusing plate and a collimation plate. The focusing and collimation plates each have circular apertures formed therein which correspond in size, number and location to the apertures formed in the anode support structure. The anode support structure is located between the anode foil and the filaments and the apertures thereof are aligned with corresponding apertures on the collimation and focusing plates to form electron beam channels between the filaments and the anode. Potentials are applied to the collimation and focusing plates such as to focus the electrons in beams through the channels with a minimum impingement of electrons on the anode support structure or the structure of the focusing or collimation plates, thereby minimizing the dissipation of beam energy and the generation of heat.

Referring now to FIG. 1, a preferred embodiment of the invention is schematically illustrated. The electron gun 11 is contained within an evacuated envelope 12 which is fabricated of a suitable non-magnetic material such as stainless steel. Mounted on a wall of envelope 12 in an aperture formed therein which typically is rectangular in configuration, but which may be round or of some other geometric shape, is metallic foil member 14 which is relatively thin and may be of a material such as aluminum, copper, or berylium, which has good thermal conduction properties as well as high electrical conductivity. Foil 14 is stretched over and supported on anode support structure 16 which not only provides structural support for the foil but also affords a heat sink therefor. The anode comprises both foil 1*r* and the support structure 16. Support structure 16 is formed from a flat apertured plate which is fabricated of a material having high thermal conductivity, such as stainless steel, berylium copper, or copper. Mounted within envelope 12 is electrically conductive shroud member 20 which is supported from the walls of the envelope by suitable support members (not shown). Shroud member 20 forms an electronic shield for the various elements of the gun and extends around such elements. Supported on shroud member 20 and electrically connected thereto is spreader plate 21 which is a flat electrically conductive plate which is substantially coextensive with filaments 23 and is placed behind such filaments in the same manner as in my aforementioned U.S. Pat. No. 3,956,712. Spaced from spreader electrode 21 and supported by suitable dielectric support means (not shown) are thermionic filaments 23. These filaments are in the form of elongated wire strings which are connected in parallel to a low voltage heater voltage supply (not shown). Typically, filaments 23 may be fabricated of a carburized thoriated tungsten.

Next in sequence is grid member 25 which is in the form of an electrically conductive wire mesh. Grid 25 which is used as an electronic accelerator is supported on shroud 20 by means of suitable dielectric support members (not shown). Focusing plate 30 is next in sequence, and is a flat electrically conductive plate which is coextensive with filaments 23 and has a plurality of circular apertures 30*a* formed therein, these apertures being distributed over the entire surface area of the plate. Focusing plate 30 is fabricated of an electrically conductive material and is supported on shroud 20 by means of suitable dielectric support members (not shown). Next in sequence in the gun structure is collimation plate 32 which is similar in configuration to the focusing plate, being a flat electrically conductive plate which is coextensive with the focusing plate having circular apertures 32a formed therein which are distributed over the entire surface area of the plate. The apertures 30a and 32a are aligned with each other and have substantially the same diameters.

The apertured anode support structure 16 for foil 14 has circular apertures 16a formed therein which are distributed over the entire surface area of the support structure. Apertures 16a are aligned with corresponding apertures 32a and 30a in focusing plate 32 and grid 30 respectively, apertures 16a having substantially the same diameter as apertures 32a and 30a. Shroud 20 and spreader plate 21 may be connected to ground (zero reference potential) as are filaments 23 (except for the small heater potential which may be of the order of several volts). It is to be noted that the spreader and shroud may be maintained at different potentials in any particular design. A high voltage potential is applied to anode 14 from high voltage power supply 35. Typically this potential is of the order of 200 kv. To avoid having the high voltage on an exposed portion of the equipment which could pose a hazard to personnel, it may be desirable to place −H.V. on the filaments and ground the anode with the other potentials being modified accordingly. An electron accelerating potential is applied to accelerator grid 25 from power source 39 to accelerate the flow of electrons between the filaments and the anode. This accelerating potential may be of the order of 200 volts. Separately controllable potentials are applied to the focusing plate 30 and collimation plate 32 from power sources 40 and 41 respectively, these potentials being adjustable by means of respective associated potentiometers 43 and 44. The voltages applied to focusing plate 30 and collimation plate 32 may be of the order of 200 volts and are adjusted to provide proper focusing of the electron beams through apertures 30a, 32a and 16a.

Referring now additionally to FIG. 2, the operation of the gun is as follows. Electrons emitted from filaments 23 are accelerated towards anode 14 by virtue of the potential on thin mesh screen grid electrode 25. The spacing between grid electrode 25 and filaments 23, as well as the potential applied to the grid with respect to the potential on filaments 23 and spreader 21, determines the space charge limited current. Potentials applied to focusing plate 30 and collimation plate 32 are adjusted to focus the electrons into a plurality of circularly focused beams as indicated at 45 (FIG. 2), these beams passing through the channels formed by aligned apertures 30a, 32a and 16a with minimum impingement on the surrounding structure. The region between grid 25 and focusing plate 30 provides a means for electrons from adjacent filaments to overlap one another in order to provide a uniform current density at the beam input surface of the focusing plate, the focusing plate in effect transforming the single large area beam into a plurality of circular beams.

The gun electron optics are designed so that electrons which deviate substantially from normal incidence to the focusing plate are either intercepted by one of the plates or straightened by the electric fields. The beams emerging from collimation plate 32 are well enough collimated and aligned with respect to apertures 16a to assure minimal interception by support structure 16. It is to be noted that the potential applied to collimation plate 32 affects the electrostatic lens between the focusing plate and the anode, and thus may be utilized to vary the diameters of the beams entering aperture 16a. It is to be noted that despite the high current interception (typically over 50%) of electrons by grid 25 and focusing plate 30, kinetic beam power dissipation from the device of the invention is low because the beam is intercepted only at low potentials.

Referring now to FIG. 2, an implementation of the preferred embodiment is pictorially illustrated. Shroud 20 is in the general form of a U-shaped member which extends around spreader plate 21, filaments 23, focusing plate 30 and collimation plate 32. Spreader plate 21 is supported on shroud 20 and electrically connected thereto by means of metal support brackets 24. As already noted, the spreader and shroud may be at different potentials, in which case support brackets 24 must be of a dielectric material. Linear wire filaments 23 are supported on the shroud structure by dielectric support members (not shown). Grid 25 is supported on shroud 20 by means of dielectric bars 47 which are connected to the shroud and the grid. Grid 25 is in the form of a thin wire mesh of a conductive material such as copper. Focusing plate 30 is supported on shroud 20 by means of dielectric support bars 49 which may be connected to the shroud and to plate 30. Collimation plate 32 is similarly supported on the shroud by means of dielectric bars 50. Support structure 16 is fixedly attached to envelope 12 with the foil anode stretched over this support structure and attached to the envelope to form a vacuum tight seal therewith. It is to be noted that only one side of the gun and anode structure has been shown in FIG. 2, the other side being identical in configuration.

While the invention has been described and illustrated in detail, it is to be clearly understood that this is intended by way of illustration and example only, and is not to be taken by way of limitation, the spirit and scope of this invention being limited only by the terms of the following claims.

I claim:

1. An area electron gun for providing a uniform flow of electrons over a predetermined area comprising:

a plurality of thermionic filaments arranged in an array to cover said predetermined area, a spreader electrode comprising a flat plate positioned on one side of said filaments, an accelerator grid member positioned on the other side of said filaments, a focusing plate having a plurality of apertures formed therein and positioned on the side of said grid member away from said filaments, a collimation plate having a plurality of apertures formed therein and positioned on the side of said focusing plate away from said grid member, an anode comprising a flat foil positioned on the side of said collimation plate away from said focusing plate, said foil forming a septum through which electrons emitted by the filament pass, and a support structure for said foil comprising a flat plate having a plurality of apertures formed therein and located between the foil and the collimation plate, one flat surface of said foil being spread over said support structure in abutment thereagainst, said filament array, spreader electrode, accelerator grid, focusing plate, collimation plate, and anode all being substantially parallel to each other with corresponding apertures of said focusing plate, collimation plate and anode support structure being aligned with each other to form electron beam channels between the filaments and the anode, means for applying a first predetermined potential between the filaments and the anode, and a second predetermined potential between the grid member and the filaments, to accelerate electrons emitted by the filaments towards the anode, and means for applying predetermined potentials to the focusing and collimation plates so as to focus the electrons in beams through said channels and minimize the impingement of electrons on the support structure, the focusing plate and the collimation plate, thereby minimizing the dissipation of beam energy and the generation of heat.

2. The area electron gun of claim 1 and further including a shroud member extending around said filaments, said spreader electrode, said accelerator grid member, said focusing plate and said collimation plate to form an electronic shield for said elements.

3. The area electron gun of claim 1 wherein said filaments are in the form of a plurality of linear wires.

4. The area electron gun of claim 1 and further comprising a housing forming a vacuum tight envelope, the filaments, spreader electrode, accelerator grid member, focusing plate, collimation plate and anode support structure being contained within said envelope, said foil forming a portion of one of the walls of said envelope.

5. The area electron gun of claim 1 wherein said accelerator grid member comprises a wire mesh.

6. The area electron gun of claim 1 wherein said means for applying predetermined potentials to the focusing and collimation plates includes means for separately adjusting the potential applied to the focusing plate and the potential applied to the collimation plate.

7. The area gun of claim 1 wherein the apertures of said focusing plate, said collimation plate and said anode support structure are circular, the beams passing through said channels being circularly focused.

* * * * *